US006315272B1

(12) United States Patent
Stanek et al.

(10) Patent No.: US 6,315,272 B1
(45) Date of Patent: Nov. 13, 2001

(54) HUMIDIFIER WITH STACKED RESERVOIR

(75) Inventors: Terrence L. Stanek, St. Charles; Mark J. Tomasiak, St. Peters, both of MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/474,444

(22) Filed: Dec. 29, 1999

Related U.S. Application Data

(60) Provisional application No. 60/114,825, filed on Jan. 6, 1999, now abandoned.

(51) Int. Cl.[7] ..... B01F 3/04

(52) U.S. Cl. ..... 261/23.1; 261/107; 261/DIG. 41; 261/DIG. 44

(58) Field of Search ..... 261/23.1, 22, 36.1, 261/21, 99, 104, 106, 107, DIG. 15, DIG. 41, DIG. 44

(56) References Cited

U.S. PATENT DOCUMENTS 223,490 * 1/1880 De Witt ..... 261/99
717,444 * 12/1902 Nagel ..... 261/104
794,938 * 7/1905 Houlon ..... 261/107
2,002,273 * 5/1935 Parker et al. ..... 261/104
2,809,820 * 10/1957 Stoops ..... 261/106
3,136,829 * 6/1964 Skerritt ..... 261/DIG. 15
3,791,102 * 2/1974 Huntington ..... 261/36.1
4,045,523 * 8/1977 Goettl ..... 261/106
5,162,088 * 11/1992 Peng et al. ..... 261/107
5,975,502 * 11/1999 Stanek et al. ..... 261/36.1
6,189,869 * 2/2001 Stanek et al. ..... 261/23.1

* cited by examiner

*Primary Examiner*—C. Scott Bushey
(74) *Attorney, Agent, or Firm*—Howrey Simon Arnold & White LLP

(57) ABSTRACT

A humidifier with a stacked reservoir system includes a first wettable wick adapted to humidify an air stream and a first reservoir for holding water. The first reservoir is located in a position adapted to wet the first wick by capillary action and shaped to accommodate sufficient air flow through the humidifier. The humidifier includes a second wettable wick adapted to humidify the air stream and a second reservoir for holding water. The second reservoir is located in a position adapted to wet the second wick by capillary action and adapted to capture water overflowing from the first reservoir.

7 Claims, 3 Drawing Sheets

HUMIDIFIER WITH STACKED RESERVOIR

CROSS-REFERENCE TO RELATED APPLICATION

This application claims the benefit of U.S. Provisional Application No. 60/114,825, now abandoned entitled "Humidifier With Stacked Reservoirs," filed Jan. 6, 1999, by the same inventors, which is incorporated herein by reference in its entirety.

BACKGROUND OF THE INVENTION

1. Field of the Invention

The present invention relates generally to humidifiers, and more specifically to a stacked reservoir system for humidifiers.

2. Description of the Related Art

FIG. 1 illustrates the operating principle of a wick system of a prior art humidifier 10. A stream of dry air 12 enters an intake 14 of the humidifier 10. The stream of dry air 12 passes through or over a wet wick 16 and picks up additional moisture to form a humid stream of air 18. The humid stream of air 18 leaves the humidifier by an output 19. One end of the wick 16 makes contact with water in a reservoir 20. Water from the reservoir 20 replenishes water carried away from the wick 16 by the stream of air 18.

Referring to FIG. 1, the wick 16 is wetted by a natural wicking action, i.e., capillary action. The wick 16 may be constructed from a variety of wettable materials, e.g., paper, provided that a substantial area of wick 16 becomes wetted through capillary action when a portion is placed in contact with water. Then, the capillary action draws water into the wick 16 to replenish moisture continually carried away by the stream of air 18.

FIG. 2 illustrates a prior art wick system 22 that uses a continuous water flow 24 to keep the wick 26 wet and capable of humidifying a stream of dry air 28. A pump 30 continually refills a reservoir 32 with water. Gravity produces the water flow 24 from the holes 23 in the bottom of the reservoir 32. The water flow 24 moves from the top to the bottom of the wick 26. Excess water drips off the wick 26 into a reservoir 34 positioned below the wick 26. The pump 30 draws water from the reservoir 34 to refill the reservoir 32. The wick system 22 uses a cyclic flow to keep the wick 26 wetted. The height of the wick 26 may be higher than height of the wick 16 of FIG. 1, which is wetted solely by capillary action.

Referring to FIG. 2, the use of a continuous flow to keep the wick 26 wetted introduces certain problems. The water flow 24 continually carries minerals contained in the wick 26 into the reservoir 34, the pump 30, and the reservoir 32. These deposits accumulate and lead to a need for periodic cleaning. Additionally, the water flow 24 through the holes 23 causes occasionally water splashing. The water splashing can create an annoying noise that is undesirable in a domestic humidifier. The splashing also deposits minerals, contained in the water, on extraneous parts. The splashing noises and accumulation of minerals, leached out of the wick 26, make the wick system 22 less desirable.

The present invention is directed to overcoming, or at least reducing the effects of, one or more of the problems set forth above.

SUMMARY OF THE INVENTION

In one aspect of the present invention, a humidifier is provided. The humidifier includes a first wettable wick adapted to humidify an air stream and a first reservoir for holding water. The first reservoir is located in a position adapted to wet the first wick by capillary action and shaped to accommodate sufficient air flow through the humidifier. The humidifier includes a second wettable wick adapted to humidify the air stream and a second reservoir for holding water. The second reservoir is located in a position adapted to wet the second wick by capillary action and adapted to capture water overflowing from the first reservoir.

In another aspect of the present invention, a method of humidifying air is provided. In accordance with this method, a plurality of water trays in a humidifier, at least one of which water trays is positioned above all other water trays, arc separately, manually filled, and dry air is moved through a plurality of wicks, each of which is associated with one of the plurality of water trays.

BRIEF DESCRIPTION OF THE DRAWINGS

Other objects and advantages of the invention will become apparent upon reading the following detailed description and upon reference to the drawings in which.

Figure 1:
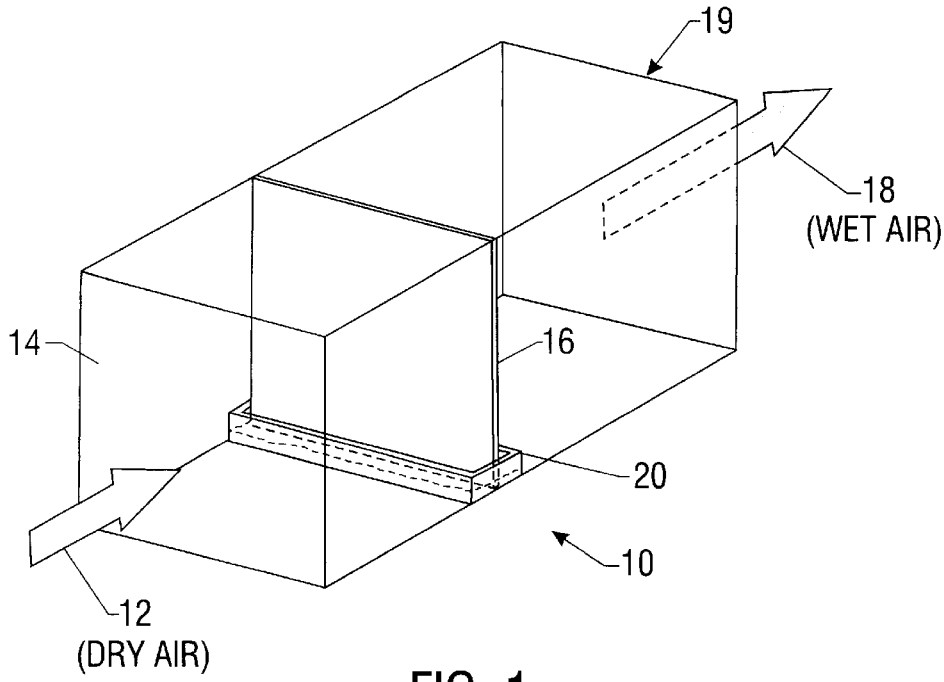
FIG. 1 (PRIOR ART)
FIG. 1 illustrates a prior art humidifier that employs capillary action to wet the wick.
Figure 2:
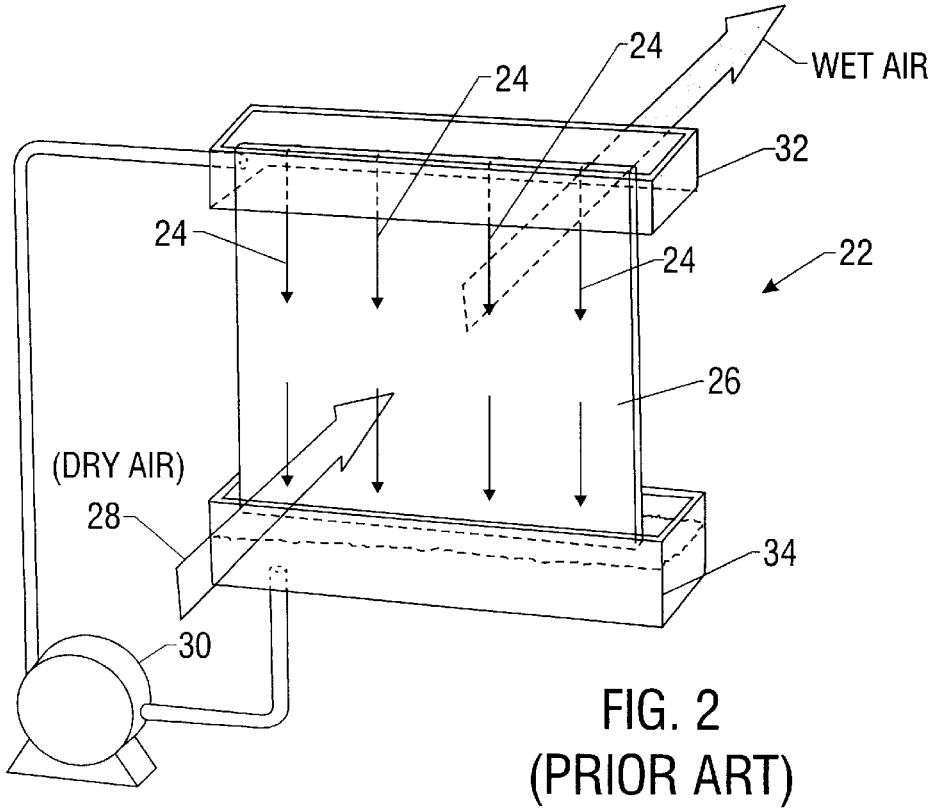
FIG. 2 (PRIOR ART)
FIG. 2 illustrates a wick system of the prior art that utilizes a continuous water flow.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 3A:
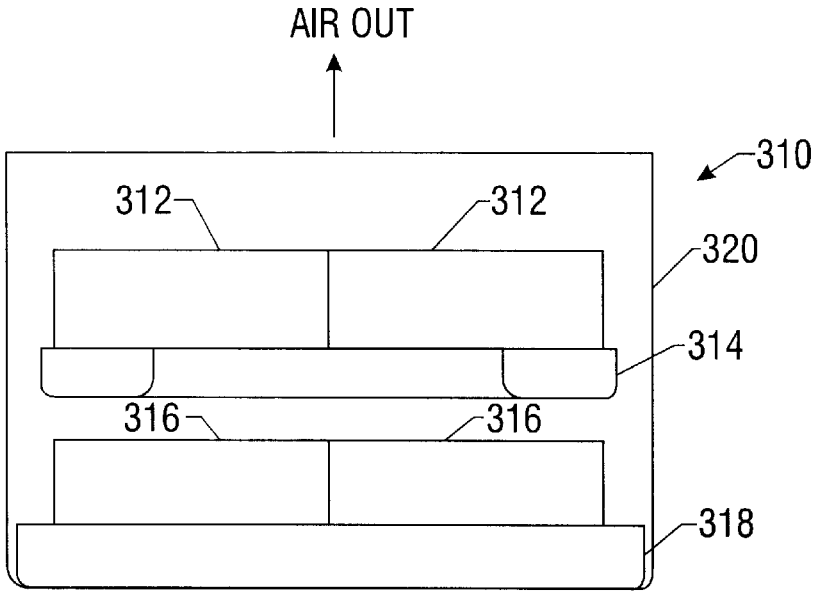
FIG. 3A illustrates the front view of the humidifier of an embodiment of the present invention.
Figure 3B:
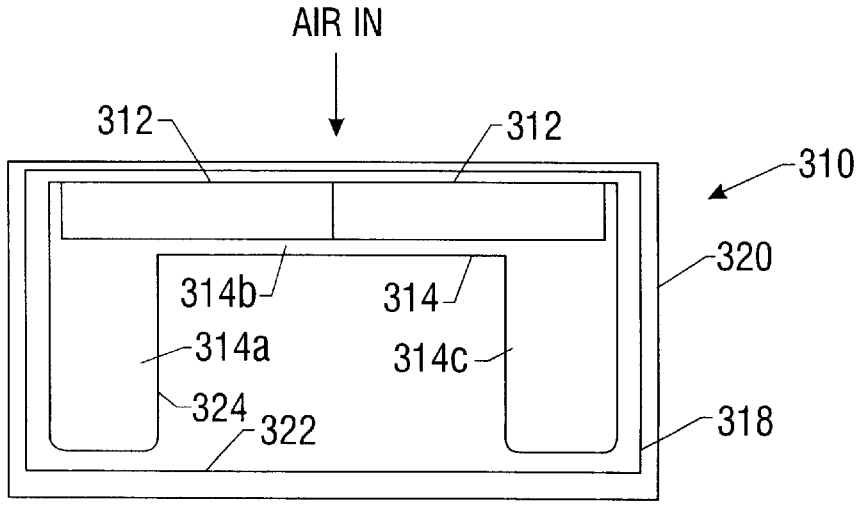
FIG. 3B illustrates the top view of the same humidifier illustrated in FIG. 3A.
Figure 4:
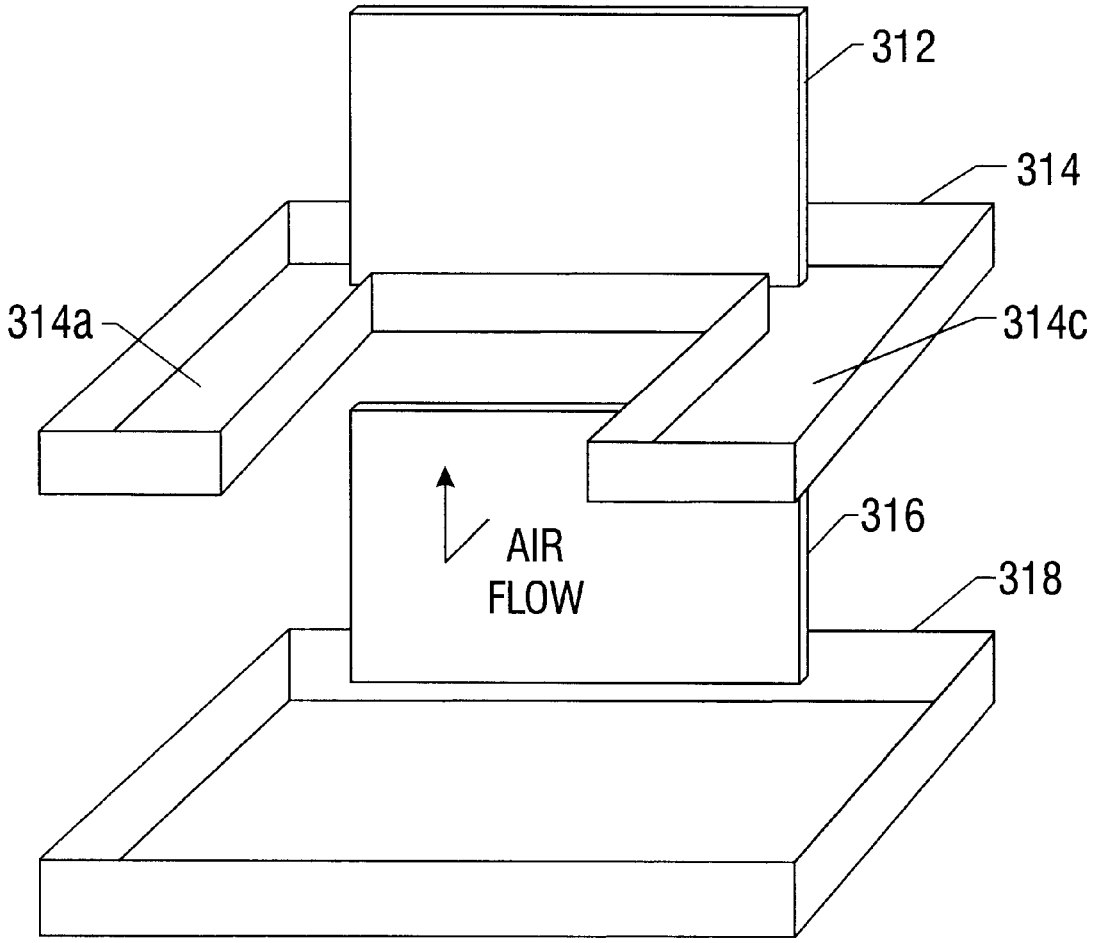
FIG. 4 shows a perspective view of wick system in the humidifier illustrated in FIGS. 3A and 3B.

An embodiment of the present invention is illustrated in FIGS. 3A, 3B and 4. A humidifier 310 includes a cabinet 320. A first wick 312 and second wick 316 are located within the cabinet 320, with the first wick 312 positioned above the second wick 316 when the humidifier 310 is viewed from the front, as shown in FIG. 3A. A first reservoir 314 is positioned under the first wick 312 such that the bottom edge of the first wick 312 may be in contact with the water held by the first reservoir 314, thereby wetting at least a portion of the first wick 312 by capillary action. A second reservoir 318, which may also simply be the lower portion of the cabinet 320, is positioned under the second wick 16 such that the bottom edge of the second wick 316 may be in contact with the water held by the second reservoir 318, thereby wetting at least a portion of the first wick 316 by capillary action. For a general form of humidifiers with "stacked" plurality of wicks and associated water trays, see the present inventors' commonly assigned and copending application, Ser. No. 09/122,905, filed on Jul. 27, 1998, now U.S. Pat. No. 5,975,502 which application is incorporated herein by reference.

The rim 322 of the second reservoir 318 in the embodiment encompasses the rim 324 of the first reservoir 314 when the humidifier 310 is viewed from top, as illustrated in FIG. 3B, so that any water flowing over the rim 324 of the first reservoir 314 is captured by the second reservoir 318.

The first reservoir 314 in the embodiment has three interconnected water channels 314*a*, 314*b* and 314*c*, which from a U-shape when viewed from above and are disposed near the walls of the cabinet 320, as illustrated in FIG. 3B. This configuration ensures substantially unobstructed flow of air from the second wick 316 to the top of the humidifier 310 through the space at the center of the U-shape while allowing the first reservoir 314 to store a sufficient amount of water so that the time interval between necessary refilling of the second reservoir 316 is maximized.

In operating the humidifier 310 of the illustrated embodiment, water is poured into the first reservoir 314 so that at least a portion of the first wick 312 is in contact with the water held by the first reservoir 314. At least a portion of the first wick 312 is wetted by capillary action. Water is also poured into the second reservoir 318 so that at least a portion of the second wick 316 is in contact with the water held by the first reservoir 318. At least a portion of the second wick 316 is wetted by capillary action. A stream of air is passed from outside of the humidifier 310 through the front of the humidifier 310, through both wicks 312 and 316, where the stream of air carries moisture away from the wetted portions of the wicks 312 and 316, and through the top of the humidifier 310, into the area to be humidified. The reservoirs 314 and 318 may be refilled as necessary.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A humidifier, comprising:

a cabinet;

a first wettable wick adapted to humidify an air stream;

a first reservoir situated in the cabinet for holding water, the first reservoir being located in a position adapted to wet at least a portion of said first wick by capillary action, the first reservoir including a plurality of interconnected water channels arranged to define an air flow opening;

a second wettable wick adapted to humidify the air stream; and a second reservoir situated in the cabinet blow the first reservoir for holding water, the second reservoir being located in a position adapted to wet at least a portion of the second wick by capillary action and to receive water overflowing from the first reservoir.

2. The humidifier as set forth in claim 1, wherein a portion of said first wick is positioned within said first reservoir; and a portion of said second wick is positioned within said second reservoir.

3. The humidifier as set forth in claim 1, wherein said first reservoir defines a first rim extending around the periphery of the first reservoir and wherein said second reservoir defines a second rim extending around the periphery of the second reservoir, and wherein the second rim encompasses the first rim to capture water overflowing the rim of said first reservoir.

4. The humidifier as set forth in claim 1, wherein the interconnected water channels are configured to form a U-shape and the first reservoir is positioned within the cabinet such that air flow from the second wick to the top of the cabinet is substantially unobstructed through inside the space defined by the U-shape.

5. A method of humidifying air, said method comprising the steps of:

situating a first reservoir in a cabinet, the first reservoir defining an air flow opening therethrough with a first wick situated in the first reservoir to receive water by capillary action therefrom;

situating a second reservoir in the cabinet below the first reservoir with a second wick situated in the second reservoir to receive water by capillary action therefrom;

dispensing water into the first reservoir so that water fills the first reservoir and overflows from the first reservoir into the second reservoir; and passing a stream of air through said first and second wicks and out of the cabinet, wherein the stream of air passing through the second wick flows through the air flow opening of the first reservoir.

6. The humidifier as set forth in claim 1, wherein the cabinet includes a lower portion that defines the second reservoir.

7. The method as set forth in claim 5, wherein situating a first reservoir in a cabinet includes situating a generally U-shaped reservoir in the cabinet, wherein the open portion of the U-shape defines the air flow opening.

* * * * *

UNITED STATES PATENT AND TRADEMARK OFFICE

CERTIFICATE OF CORRECTION

PATENT NO. : 6,315,272 B1 
DATED : November 13, 2001
INVENTOR(S) : Terrence L. Stanek and Mark J. Tomasiak It is certified that error appears in the above-identified patent and that said Letters Patent is hereby corrected as shown below:

Column 2,
Line 14, delete “arc” and insert -- are --.

Column 4,
Line 10, delete “blow” and insert -- below --.

Signed and Sealed this

Second Day of July, 2002

*Attest:*

*Attesting Officer*

JAMES E. ROGAN
*Director of the United States Patent and Trademark Office*